US009882300B2

(12) United States Patent
Yamakami et al.

(10) Patent No.: US 9,882,300 B2
(45) Date of Patent: Jan. 30, 2018

(54) CONNECTOR

(71) Applicant: FUJITSU COMPONENT LIMITED, Tokyo (JP)

(72) Inventors: Tohru Yamakami, Tokyo (JP); Koichi Kiryu, Nagano (JP); Takahiro Kondo, Tokyo (JP); Mitsuru Kobayashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/531,559

(22) PCT Filed: Dec. 4, 2015

(86) PCT No.: PCT/JP2015/084116
§ 371 (c)(1),
(2) Date: May 30, 2017

(87) PCT Pub. No.: WO2016/088869
PCT Pub. Date: Jun. 9, 2016

(65) Prior Publication Data

US 2017/0331213 A1 Nov. 16, 2017

(30) Foreign Application Priority Data

Dec. 5, 2014 (JP) ..... 2014-247106

(51) Int. Cl.
*H01R 13/62* (2006.01)
*H01R 13/193* (2006.01)

(52) U.S. Cl.
CPC ..... *H01R 13/193* (2013.01)

(58) Field of Classification Search
CPC ..... H01R 13/62938; H01R 13/62933; H01R 13/633; H01R 13/635; H01R 23/7005
USPC ..... 439/157, 372, 152, 153, 155, 160
See application file for complete search history.

(56) References Cited

U.S. PATENT DOCUMENTS 5,516,308 A * 5/1996 Yamanashi ..... H01R 13/4362 439/752
6,244,885 B1 6/2001 Iwahori
6,478,593 B2 11/2002 Miwa
(Continued)

FOREIGN PATENT DOCUMENTS

GB 1499860 2/1978
JP S51-093385 8/1976
(Continued)

*Primary Examiner* — Phuong Chi T Nguyen
(74) *Attorney, Agent, or Firm* — IPUSA, PLLC

(57) ABSTRACT

A connector includes a housing, a terminal housed in the housing and configured to contact a terminal of another connector, a pivoting part pivotably housed in the housing, wherein a contact part configured to contact the housing of the other connector is formed at a first end of the pivoting part and a pressing part configured to press the terminal of the connector is formed at a second end of the pivoting part, and a spring that urges the pivoting part. In connecting the connector to the other connector, the housing of the other connector contacts the contact part to pivot the pivoting part in a first direction to have the pressing part press the terminal of the connector toward the terminal of the other connector.

4 Claims, 4 Drawing Sheets

(56) References Cited

U.S. PATENT DOCUMENTS

| | | | | |
|---|---|---|---|---|
| 6,817,901 | B2 * | 11/2004 | Nishide | H01R 13/4365 439/474 |
| 9,509,093 | B2 * | 11/2016 | Shimizu | H01R 13/62938 |
| 2004/0235365 | A1 * | 11/2004 | Fujita | H01R 13/516 439/752 |
| 2014/0057471 | A1 | 2/2014 | Lee | |

FOREIGN PATENT DOCUMENTS

| | | | |
|---|---|---|---|
| JP | S56-127684 | U | 9/1981 |
| JP | H05-097074 | U | 12/1993 |
| JP | 2000-260521 | | 9/2000 |
| JP | 2001-250621 | | 9/2001 |
| JP | 2002-324624 | | 11/2002 |

* cited by examiner

CONNECTOR

TECHNICAL FIELD

The present invention relates to connectors.

BACKGROUND ART

Electrical apparatuses are supplied with electric power through a connector. According to the connector employed in this case, a male-ended connector having a protruding shape and a female-ended connector having an indented shape mate with each other to establish an electrical connection as disclosed in Patent Documents 1 to 3.

In recent years, as a measure against global warming, supplying direct-current, high-voltage electric power, which is limited in power loss in voltage conversion or power transmission and does not require an increase in cable thickness, has been studied. Such a supply of electric power is considered desirable particularly for information apparatuses such as servers, which consume a large amount of electric power.

Electric power supplied to electrical apparatuses may affect a human body or the operations of electronic components if the voltage is high. In the case of using high-voltage electric power for information apparatuses such as servers, because the apparatuses are installed or maintained by human work, the connector needs to be different from connectors used for a common alternating-current commercial power supply.

PRIOR ART DOCUMENTS

[Patent Document 1] Japanese Examined Utility Model Publication No. 5-97074

[Patent Document 2] Japanese Laid-Open Patent Application No. 2001-250621

[Patent Document 3] Japanese Laid-Open Patent Application No. 2002-324624

SUMMARY OF THE INVENTION

Problems to be Solved by the Invention

When the voltage supplied from the power supply is 100 V or higher or a direct-current high voltage such as direct-current 400 V, it is dangerous to use connectors presently used for alternating-current 100V as they are because sufficient safety or reliability is not ensured.

The present invention is made in view of the above, and has an object of providing a connector capable of safely supplying high-voltage electric power.

Means for Solving the Problems

According to an aspect of the present invention, a connector includes a housing, a terminal housed in the housing and configured to contact a terminal of another connector, a pivoting part pivotably housed in the housing, wherein a contact part configured to contact the housing of the other connector is formed at a first end of the pivoting part and a pressing part configured to press the terminal of the connector is formed at a second end of the pivoting part, and a spring that urges the pivoting part. In connecting the connector to the other connector, the housing of the other connector contacts the contact part to pivot the pivoting part in a first direction to have the pressing part press the terminal of the connector toward the terminal of the other connector.

Effects of the Invention

According to an aspect of the present invention, it is possible to provide a connector that is compatible with power supplies higher in voltage than presently-available commercial power supplies or with direct-current power supplies and capable of safely supplying electric power from these power supplies.

EMBODIMENTS OF THE INVENTION

Figure 1:
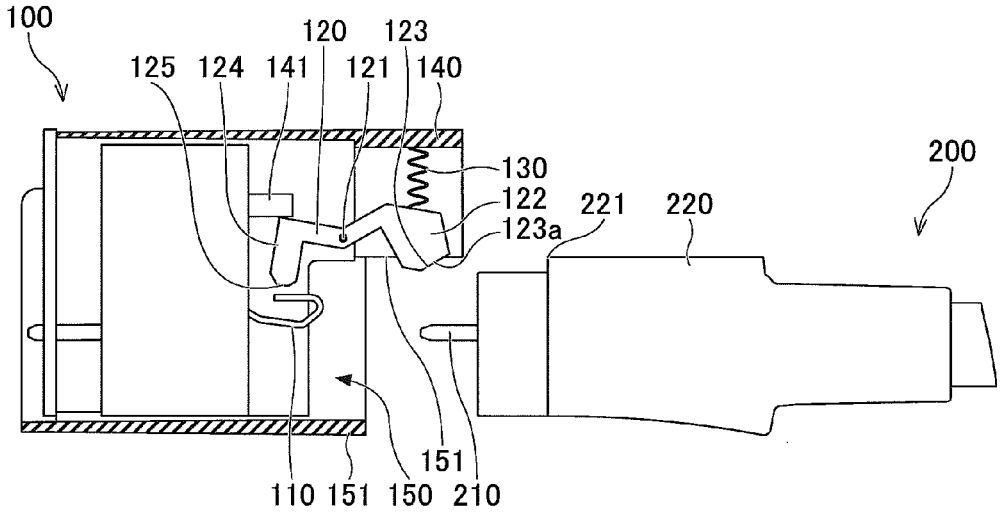
FIG. 1 is a cutaway view depicting a structure of a connector according to an embodiment.

An embodiment of the present invention is described below. The same members are given the same reference numeral, and are not repeatedly described.

A connector according to this embodiment is described with reference to FIG. 1. The connector according to this embodiment is a jack connector 100, and mates with and electrically connects to a plug connector 200.

The jack connector 100 includes multiple jack terminals 110 that serve as connection terminals, a pivoting part 120, a spring 130 that urges the pivoting part 120, and a jack housing 140 formed of an insulating resin material. The jack housing 140 houses the jack terminals 110, the pivoting part 120, and the spring 130. A jack opening 150 for inserting the plug connector 200 is formed in the jack housing 140. In the drawings, one of the jack terminals 110 is depicted, and the following description is given, taking one of the jack terminals 110 as an example. Furthermore, a description of one of the jack terminals 110 may also be applied to the other jack terminals 110.

The jack terminal 110 is formed of a conductive metal material such as copper, and has resilience. The jack terminal 110 is covered with the jack housing 140. The pivoting part 120 is formed of an insulating material, and is provided in the jack housing 140 to be pivotable about a pivot axis 121. A contact part 123 is formed at a first end 122 of the pivoting part 120 and a depressing part 125 (a pressing part) is formed at a second end 124 of the pivoting part 120 opposite to the first end 122. A tapered part 123*a* that contacts a plug housing 220 is formed in the contact part 123. The spring 130 has one end connected to the inside of the jack housing 140 and another end connected to the first end 122 of the pivoting part 120.

An edge 151 is formed around the jack opening 150 of the jack housing 140. When the jack connector 100 is not mated to the plug connector 200, part of the contact part 123 is projected from the edge 151 into the jack opening 150 by the force of the spring 130. In this state, the second end 124 of the pivoting part 120 is held by a support part 141 provided in the jack housing 140 to prevent the pivoting part 120 from further pivoting clockwise from the state depicted in FIG. 1.

The plug connector 200 includes the plug housing 220 and multiple plug terminals 210 housed in the plug housing 220. The plug housing 220 is formed of a resin material. The plug terminals 210 are formed of a metal material. A corner 221 that contacts the contact part 123 is formed in the plug housing 220. A portion of the plug housing 220 where the corner 221 is formed is stepped.

Next, connector mating according to this embodiment is described. According to this embodiment, when the plug connector 200 is mated with the jack connector 100, a leading end portion of the plug housing 220 in which the plug terminals 210 are provided is inserted into the jack opening 150. In the drawings, one of the plug terminals 210 corresponding to the jack terminal 110 is depicted.

Figure 2:
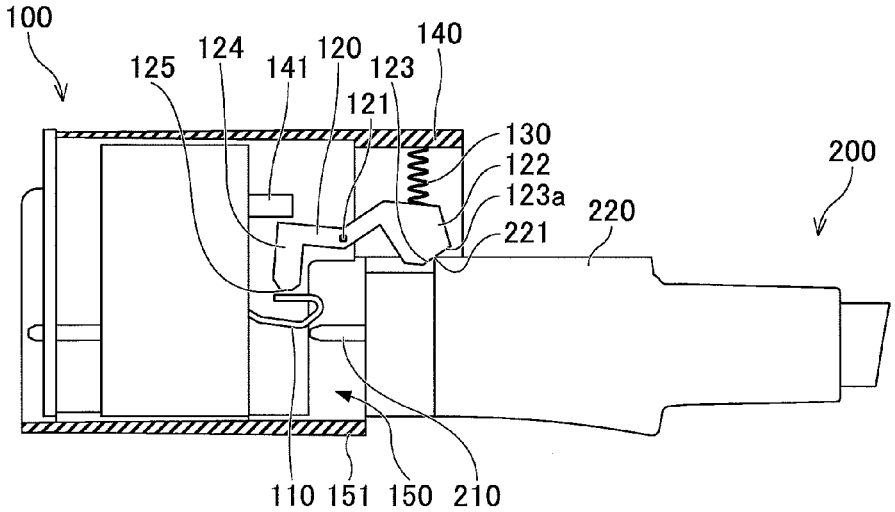
FIG. 2 is a diagram illustrating a method of connecting a connector according to the embodiment.

Specifically, the plug connector 200 is inserted into the jack opening 150 as depicted in FIG. 2. As a result, the corner 221 of the plug housing 220 contacts the tapered part 123*a* provided in the contact part 123 of the pivoting part 120. Entry of the plug terminal 210 into the jack opening 150 alone does not bring the jack terminal 110 and the plug terminal 210 into contact.

As the plug connector 200 is inserted further into the jack opening 150, the tapered part 123*a* contacting the corner 221 is pressed upward to pivot the pivoting part 120 counterclockwise about the pivot axis 121. According to this embodiment, it is assumed that the counterclockwise direction is a first direction and the clockwise direction is a second direction.

Figure 3:
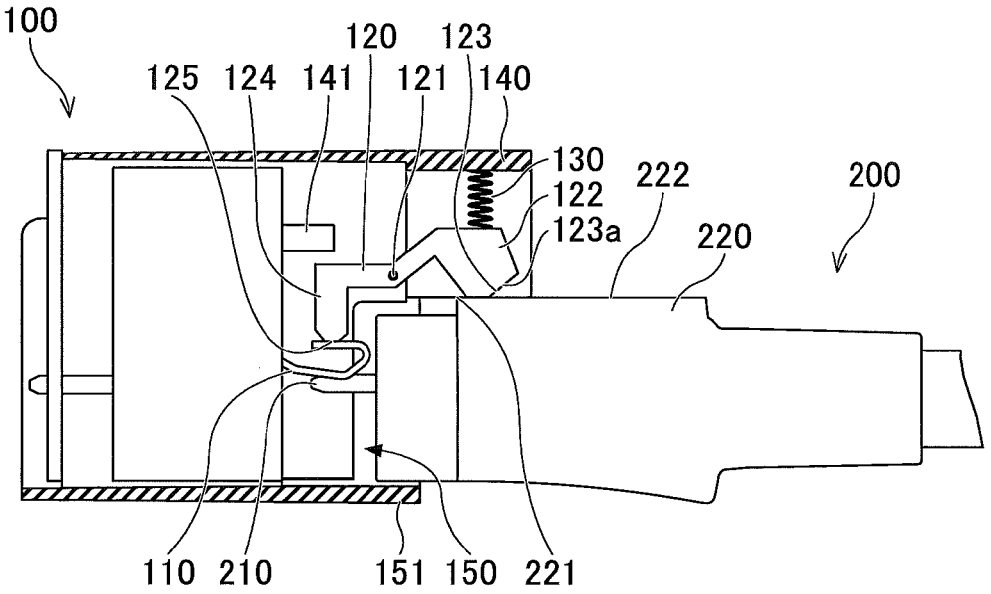
FIG. 3 is a diagram illustrating the method of connecting a connector according to the embodiment.

As depicted in FIG. 3, by inserting the plug connector 200 further into the jack opening 150, the tapered part 123*a* contacting the corner 221 of the plug housing 220 is further pressed upward to further pivot the pivoting part 120 counterclockwise from the position depicted in FIG. 2. Thereafter, as a result of a further movement of the plug connector 200 into the jack opening 150, the contact part 123 contacts an upper surface 222 of the plug housing 220.

Figure 4:
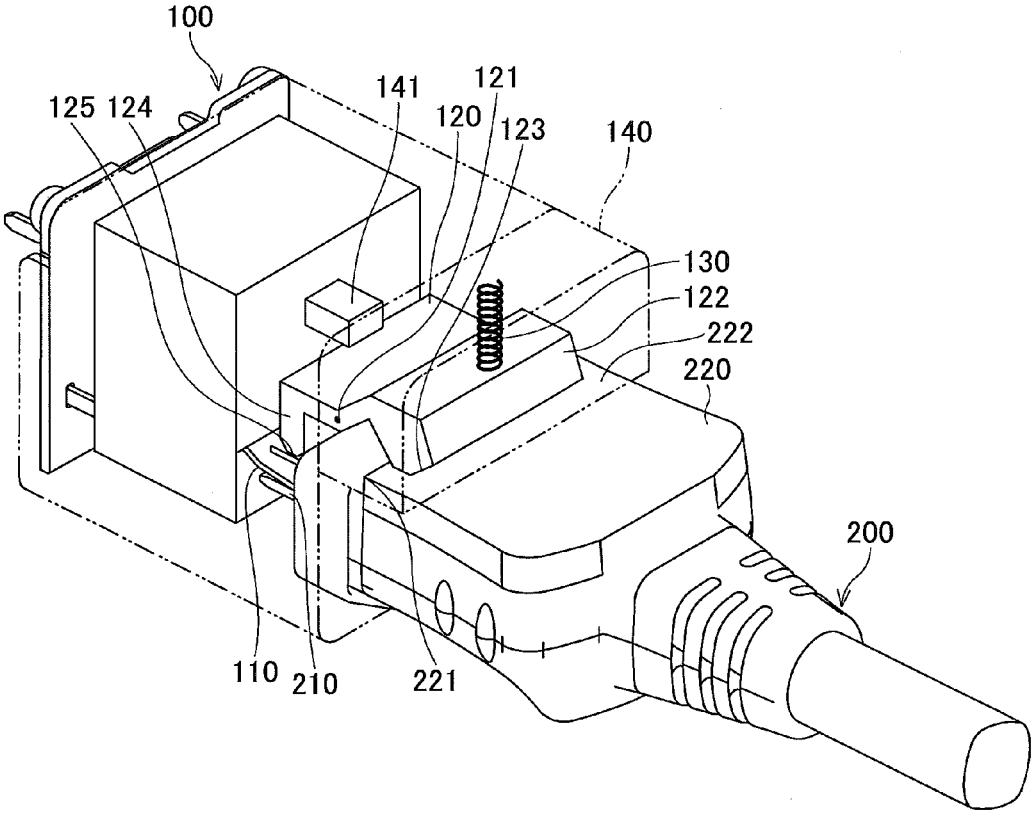
FIG. 4 is a perspective view of the connected connector according to the embodiment.

When the plug terminal 210 is in the jack terminal 110, the depressing part 125 provided at the second end 124 of the pivoting part 120 depresses the jack terminal 110 from above to cause the jack terminal 110 to deform to contact the plug terminal 210. As a result, the jack connector 100 and the plug connector 200 are electrically connected. FIG. 4 is a perspective view of the electrically connected jack connector 100 and plug connector 200.

In the state of FIG. 3, because the contact part 123 is in contact with the plug housing 220, the pivoting part 120 is prevented from pivoting clockwise to keep the jack terminal 110 and the plug terminal 210 in contact.

Figure 5:
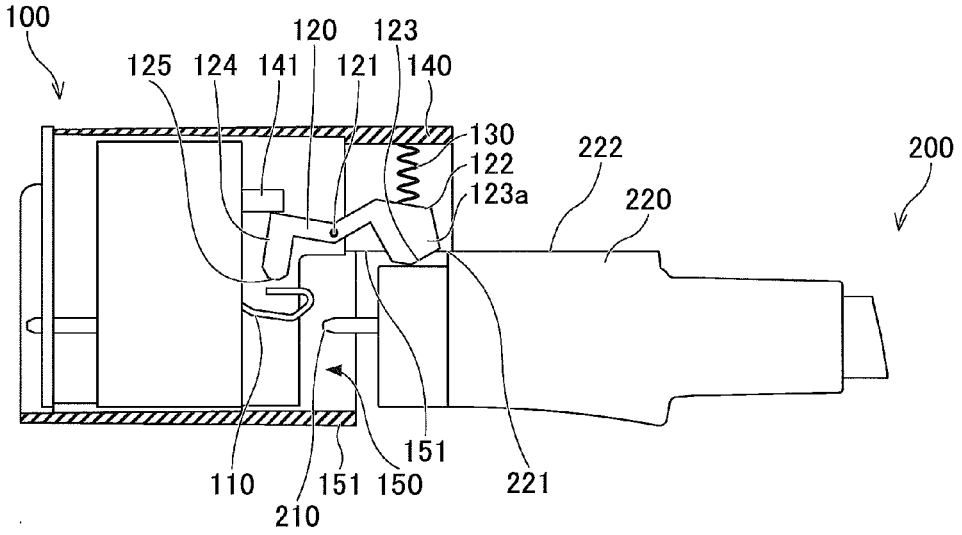
FIG. 5 is a diagram illustrating a method of removing a connector according to the embodiment.

Next, a removal of the plug connector 200 from the jack connector 100 is described. According to this embodiment, by pulling the plug connector 200 out of the jack connector 100 in the state depicted in FIG. 3, the contact part 123 is separated from the corner 221 of the plug connector 200 as depicted in FIG. 5. As a result of the separation of the contact part 123 from the corner 221, the first end 122 of the pivoting part 120 supported by the plug housing 220 is pressed downward in FIG. 5 by the force of the spring 130, so that the pivoting part 120 pivots clockwise about the pivot axis 121. Because a step is formed by the corner 221 in the plug housing 220, the separation of the contact part 123 from the corner 221 pivots the pivoting part 120 clockwise at once.

As a result of the pivoting part 120 thus pivoting clockwise at once, the depressing part 125 is separated from the jack terminal 110 at once. As a result of the depressing part 125 and the jack terminal 110 being separated at once, the jack terminal 110 moves up because of its own resilience. As a result, the jack terminal 110 and the plug terminal 210 are instantaneously separated. Therefore, it is possible to prevent the generation of an arc between the jack terminal 110 and the plug terminal 210.

Figure 6:
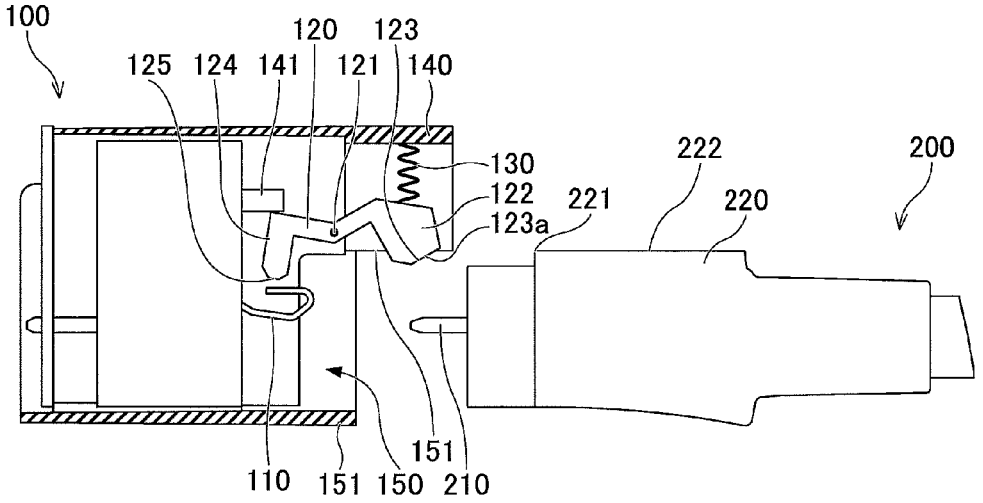
FIG. 6 is a diagram illustrating the method of removing a connector according to the embodiment.

Thereafter, by further pulling the plug connector 200 out of the jack connector 100, the jack connector 100 and the plug connector 200 are separated as depicted in FIG. 6.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. A connector has been described based on one or more embodiments of the present invention. It should be understood, however, that the various changes, substitutions, and alterations could be made hereto without departing from the spirit and scope of the invention.

DESCRIPTION OF THE REFERENCE NUMERALS

100 jack connector
110 jack terminal
120 pivoting part
121 pivot axis
122 first end
123 contact part
123*a* tapered part
124 second end
125 depressing part
140 jack housing
141 support part
150 jack opening
151 edge
200 plug connector
210 plug terminal
220 plug housing
221 corner

The invention claimed is:

1. A connector, comprising:

a housing;

a terminal housed in the housing and configured to contact a terminal of another connector;

a pivoting part pivotably housed in the housing, wherein a contact part configured to contact a housing of said another connector is formed at a first end of the pivoting part and a pressing part configured to press the terminal of the connector is formed at a second end of the pivoting part; and a spring that urges the pivoting part, wherein, in connecting the connector to said another connector, the housing of said another connector contacts the contact part to pivot the pivoting part in a first direction to have the pressing part press the terminal of the connector toward the terminal of said another connector.

2. The connector as claimed in claim 1, wherein, in removing said another connector from the connector, upon separation of the contact part from the housing of said another connector, the pivoting part pivots in a second direction opposite to the first direction because of an urging force of the spring to separate the pressing part and the terminal of the connector to separate the terminal of the connector and the terminal of said another connector.

3. The connector as claimed in claim 1, wherein the spring urges the contact part in a direction to project the contact part into an opening of the housing of the connector.

4. The connector as claimed in claim 3, wherein the contact part includes a tapered part, the tapered part being configured to contact the housing of said another connector and to be urged toward the housing of said another connector by the spring during insertion of said another connector into the opening.

* * * * *